US006691518B2

(12) United States Patent
Doebbeling et al.

(10) Patent No.: US 6,691,518 B2
(45) Date of Patent: Feb. 17, 2004

(54) PROCESS FOR THE OPERATION OF AN ANNULAR COMBUSTION CHAMBER, AND ANNULAR COMBUSTION CHAMBER

(75) Inventors: Klaus Doebbeling, Windisch (CH); Hans Peter Knoepfel, Dottikon (CH); Christian Oliver Paschereit, Baden (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/067,285

(22) Filed: Feb. 7, 2002

(65) Prior Publication Data

US 2002/0134086 A1 Sep. 26, 2002

(30) Foreign Application Priority Data

Feb. 22, 2001 (DE) ..... 101 08 560

(51) Int. Cl.[7] ..... F02C 3/228
(52) U.S. Cl. ..... 60/776; 60/737; 60/804
(58) Field of Search ..... 60/725, 737, 776, 60/804; 431/114, 350, 351, 352, 353, 354, 355

(56) References Cited

U.S. PATENT DOCUMENTS

| | | | | | |
|---|---|---|---|---|---|
| 3,010,281 | A | | 11/1961 | Cervenka et al. | |
| 5,081,844 | A | * | 1/1992 | Keller et al. | 60/737 |
| 5,274,993 | A | * | 1/1994 | Keller | 60/39.37 |
| 5,323,614 | A | * | 6/1994 | Tsukahara et al. | 60/737 |
| 5,450,725 | A | * | 9/1995 | Takahara et al. | 60/737 |
| 5,482,457 | A | | 1/1996 | Aigner et al. | |
| 5,558,515 | A | * | 9/1996 | Althaus et al. | 431/284 |
| 5,687,571 | A | * | 11/1997 | Althaus et al. | 60/737 |
| 5,829,967 | A | * | 11/1998 | Chyou | 431/350 |
| 5,983,643 | A | * | 11/1999 | Kiesow | 60/746 |
| 6,370,863 | B2 | * | 4/2002 | Muller et al. | 60/776 |
| 6,449,951 | B1 | * | 9/2002 | Joos et al. | 60/725 |

FOREIGN PATENT DOCUMENTS

| | | |
|---|---|---|
| DE | 19615910 A1 | 10/1997 |
| EP | 0387532 A1 | 9/1990 |
| EP | 0616170 A1 | 9/1994 |
| EP | 0747635 A2 | 12/1996 |
| EP | 0597138 B1 | 7/1997 |
| FR | 2694799 | 2/1994 |

OTHER PUBLICATIONS

Sanjay M. Correa, "A Review of $No_x$ Formation Under Gas–Turbine Combustion Conditions", Combust. Sci. and Tech. 1992, vol. 87. pp. 329–362.

* cited by examiner

*Primary Examiner*—Ehud Gartenberg
(74) *Attorney, Agent, or Firm*—Burns, Doane, Swecker & Mathis, L.L.P.

(57) ABSTRACT

A process is described for the operation of an annular combustion chamber and also an annular combustion chamber is shown with numerous circularly arranged premix burners, in which a fuel-air mixture is produced before it is ignited and the fuel-air mixture is used as a hot gas stream to drive at least one turbine stage of a gas turbine plant. At least one premix burner is operated such that it has a spatial mixing profile deviating within the fuel-air mixture from all other premix burners.

8 Claims, 2 Drawing Sheets

PROCESS FOR THE OPERATION OF AN ANNULAR COMBUSTION CHAMBER, AND ANNULAR COMBUSTION CHAMBER

FIELD OF THE INVENTION

The invention relates to a process for the operation of an annular combustion chamber and to an annular combustion chamber with numerous circularly arranged premix burners, in which a fuel-air mixture is produced before it is ignited and the fuel-air mixture is used as a hot gas stream for driving at least one turbine stage of a gas turbine plant.

BACKGROUND OF THE INVENTION

Premix combustion has become established in the combustion of liquid or gaseous fuels in a combustion chamber of a gas turbine. The fuel and the combustion air are premixed as uniformly as possible and then conducted into the combustion chamber. In order to be correct from an environmental standpoint, care is taken to obtain a low flame temperature by means of a large excess of air. Nitrogen oxide formation can be kept low in this manner.

In this connection, annular combustion chambers have become established, providing numerous individual premix burners in a circular arrangement around the rotating components of a gas turbine, with their hot gases supplied directly to the following turbine stage via an annularly constituted flow channel.

A related annular combustion chamber with premix burners for a gas turbine is known, for example, from EP-B1-597 138. The premix burners provided at the head end of the annular combustion chamber are known, for example, from EP-A1-387 532. Double cone burners are used in such premix burners. This kind of premix burner consists essentially of two hollow, conical partial members which are nested in the flow direction. The respective mid-axes of the two partial members are mutually offset. The adjacent walls of the two partial members form, in their length extension, tangential slots for the combustion air, which reaches the interior of the burner in this manner. A fuel nozzle for liquid fuel is arranged adjacent the tangential slots. The fuel is injected into the hollow cone at an acute angle. The resulting conical liquid fuel profile is enclosed by the tangentially inflowing combustion air. The concentration of the fuel progressively decreases in the axial direction because of mixing with the combustion air.

The premix burners can likewise be operated with gaseous fuel. For this purpose, gas inflow openings distributed in the longitudinal direction, the so-called premix perforations, are provided in the region of the tangential slots in the walls of the two partial members. In gas operation, the mixture formation with the combustion air thus already begins in the zone of the inlet slots. It will be understood that a mixed operation with two kinds of fuel is possible in this manner. As homogeneous as possible, a fuel concentration occurs at the burner outlet over the annular cross section involved. A defined cup-shaped backflow zone, at the top of which ignition occurs, arises at the burner outlet.

Now it is known from various documents, for example, *Combust. Sci. and Tech.* 1992, Vol. 87, pages 329–362, that with a perfectly premixed flame, the magnitude of the backflow zone, which is equally as important as the so-called flame stabilization region, has no effect on the nitrogen oxide emissions. On the other hand, however, the carbon oxide emissions, and also emissions of unsaturated hydrocarbons (UHC), and especially the extinction limits of the respective premix burners, are strongly affected by the size of the backflow zone. This means that the larger the backflow zone is constituted, the more the carbon oxide emissions, the emissions of unsaturated hydrocarbons, and also the extinction limits, decrease. The consequence of this is that with a larger backflow zone, a greater load region of the premix burner can be covered without the flame being extinguished.

Besides the size of the backflow zone, which as explained above has a critical effect on the manner of operation of the individual premix burners, the fuel distribution, i.e., the mixing profile of the fuel/air mixture in the flame stabilization region, also plays a large part. In a manner known per se, the mixing profile between fuel and air within the premix burner is determined by the premix perforation pattern, i.e., the spatial arrangement of the apertures, typically distributed along the air inlet slots and through which premix fuel, preferably premix gas, is injected into the interior of the premix burner.

All the premix burners are normally given identical premix perforation patterns in annular combustion chambers for the operation of a gas turbine. It is found, though, that different operating regions of the gas turbine arise due to the different load conditions of the gas turbine plant and are characterized by strong combustion chamber pulsations, poor burnup with regard to carbon oxide values and unsaturated hydrocarbon values, and also poor transverse ignition behavior of the individual premix burners. It is critical to improve these characteristics of conventional premix burners.

SUMMARY OF THE INVENTION

The invention provides a process for the operation of an annular combustion chamber and also a related annular combustion chamber, in which a fuel-air mixture is produced before being ignited and the fuel-air mixture is used as a hot gas stream for driving at least one turbine stage of a gas turbine plant, such that the disadvantages mentioned hereinabove are to be avoided. In particular, measures are to be found which decisively counteract the combustion chamber pulsations which arise. Furthermore, on environmental grounds and the increasingly stringent guidelines regarding emission values, burnup is to become more complete, and the CO, UHC and $NO_x$ emissions reduced.

According to the invention, a process for the operation of a combustion chamber with numerous circularly arranged premix burners includes at least one premix burner being operated such that the at least one premix burner has a spatial mixing profile within the fuel-air mixture differing from all the other premix burners.

According to the invention, an annular combustion chamber is provided with at least one premix burner having at least one region in the premix gas perforation in which adjacent premix gas holes have a different distance from one another than in the remaining region of the premix gas perforation.

The invention deliberately breaks the symmetry which is constructionally predetermined by the circular arrangement of a plurality of identically constructed premix burners around the rotating components of a gas turbine plant. Since identically constructed premix burners are usually arranged annularly around the rotating components of the gas turbine plant, and because of their identical constitution they respectively form identical mixing profiles within the individual fuel-air mixtures. The identical mixing profiles are a consequence of the identical premix perforation patterns. As a result, pulsating waves are formed, circulating in certain load regions of the annular combustion chamber, and the pulsating waves have to be specifically suppressed.

If, on the contrary, a deliberate asymmetry is imposed on the conventional symmetrical structure, the symmetry produced by the identical structure of all the premix burners is broken, and thus no circulating pulsation vibrations caused by resonances can occur.

Such an asymmetry is forced according to the invention in that at least one, preferably three or more, premix burners have a different premix perforation, the premix perforation pattern of which differs from all the remaining premix burners. By the deliberate use of premix perforation patterns deviating from the otherwise identically distributed premix perforation pattern, different mixing profiles are produced, and in turn lead to different burnup results. This finally leads to a decisive damping or counteracting of pulsations which otherwise circulate in the annular combustion chamber, circularly constituted in resonant form. In particular, the measures according to the invention lead to the following advantages:

1. more stable flame position
2. lower emissions of CO, UHC, $NO_x$
3. complete burnup
4. greater operating range without flame extinction
5. improved transverse ignition properties between two adjacent premix burners, and
6. smaller pulsations.

BRIEF DESCRIPTION OF THE DRAWINGS

The invention is described in exemplary manner hereinafter, using an embodiment example with reference to the accompanying drawing, without limitation of the general concept of the invention, whereby.

DETAILED DESCRIPTION OF THE PREFERRED EMBODIMENTS

Figure 1:
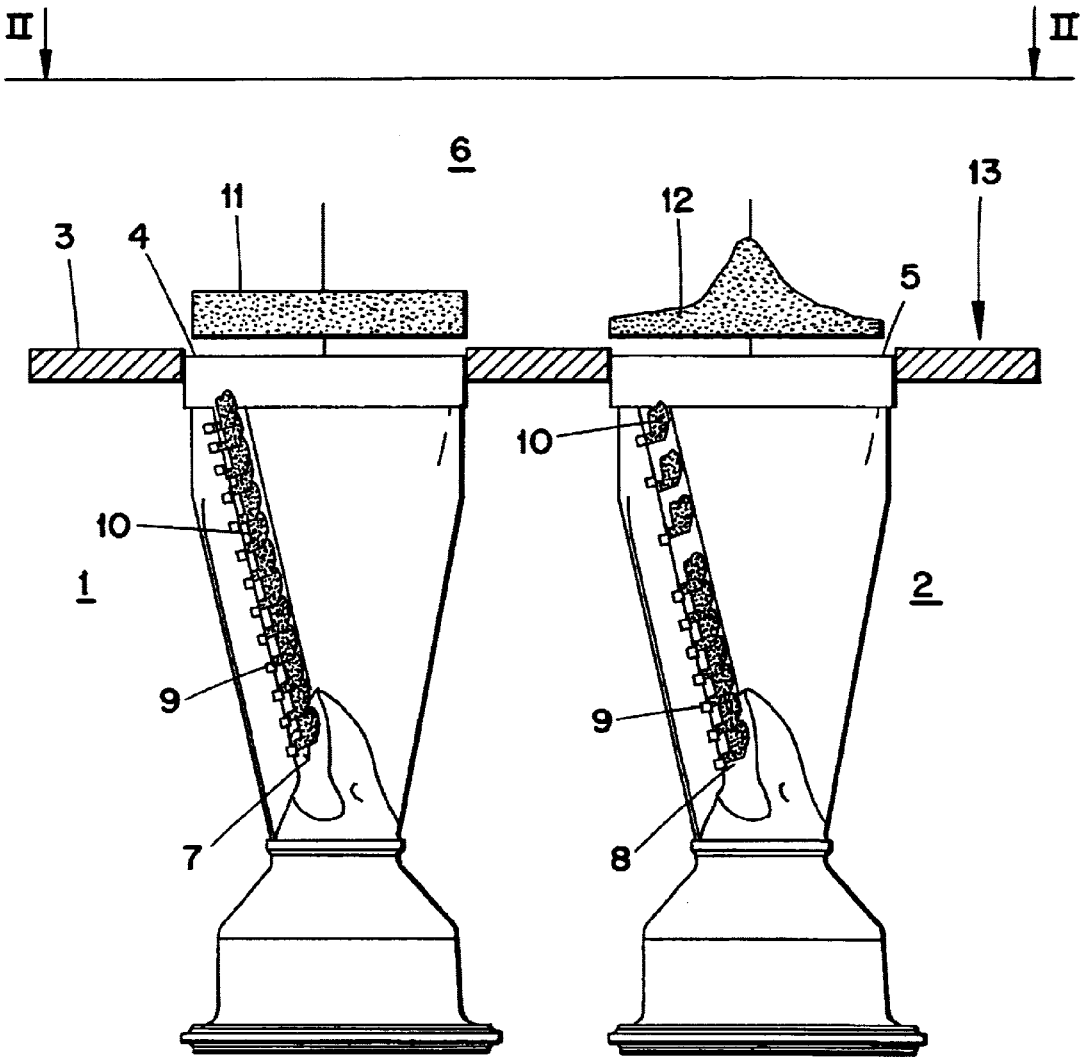
FIG. 1 shows a longitudinal section through two adjacent premix burners circularly arranged within an annular combustion chamber, as taken in the direction of the line I—I in FIG. 2.
Figure 2:
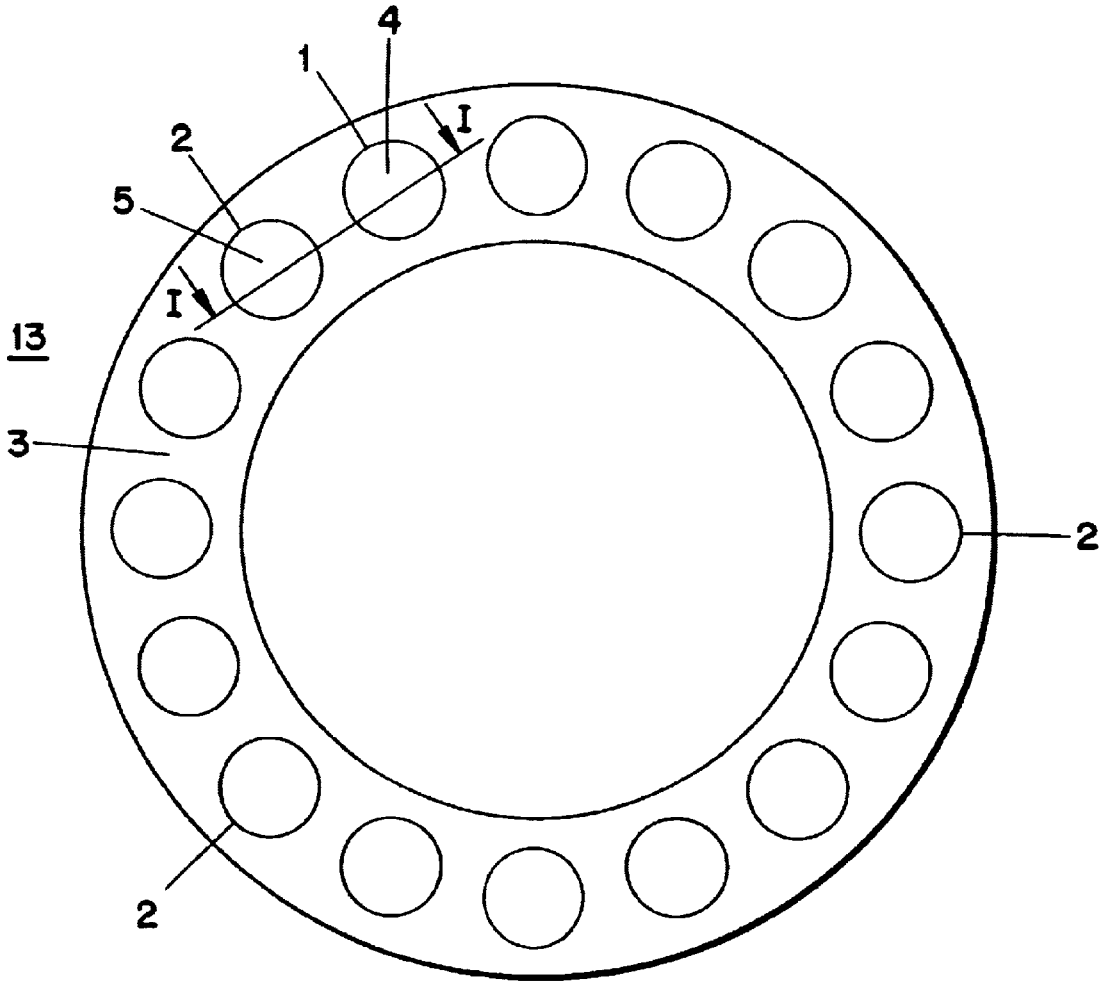
FIG. 2 shows a view in the direction of the line II—II in FIG. 1.

A longitudinal section is shown in FIG. 1, taken in the direction of the line I—I in FIG. 2, through two neighboring premix burners 1, 2, which are arranged adjacent to one another on an annular front plate 3 circling an annular combustion chamber 13. A schematic view of the annular combustion chamber along the line II—II in FIG. 1 can be seen in FIG. 2. The premix burners 1, 2, of conical construction, have an outlet aperture 4, 5 opening downstream into the combustion chamber 6. The premix burners 1, 2 each have a premix fuel perforation 9 along their air inlet slots 7, 8, with the premix fuel perforation 9 consisting of individual apertures through which preferably gaseous fuel 10 flows into the interior of the conically constituted premix burner 1, 2.

The spatial distribution of the premix gas perforation 9 of the premix burner 1 is homogeneously distributed in a conventional manner, i.e., the premix gas holes are arranged equidistantly from one another. With such a premix perforation pattern, a spatially uniformly distributed, homogeneous mixing profile 11 is generally produced over the whole cross section of the outlet aperture 4.

In contrast to this, the premix burner 2 has two regions along the premix perforation pattern in which the individual premix gas holes 9 have different distances from one another. With the premix perforation pattern of the premix burner 2 in the embodiment example shown in FIG. 1, in which the premix holes arranged downstream have a greater mutual distance than upstream, a mixing profile 12 is obtained which is constituted in the manner of a gaussian distribution. By the provision of such a premix burner 2 in the circular overall arrangement of all the premix burners within the annular combustion chamber 13, a deliberate asymmetry in combustion behavior along the circularly forming hot gases is introduced, whereby, as stated hereinabove, the formation of combustion chamber pulsations can be effectively counteracted.

As is clear from FIG. 2, at least three premix burners 2 can be constituted in the above manner in order for effective avoidance of the pulsations within the combustion chamber, and the at least three premix burners are arranged circularly equally distributed around the annular combustion chamber 13.

The premix perforation pattern of the premix burner 2 can also be constructed such that the mutual distances between upstream perforations within the premix burner are greater than the distances between downstream perforations of the premix burner 2, whereby a correspondingly inverted mixing profile can be produced with respect to the mixing profile shown in FIG. 1 with reference to the premix burner 2.

Of course it is also possible to implement further premix perforation patterns, deviating from the homogeneous premix perforation arrangement.

What is claimed is:

1. A process for the operation of an annular combustion chamber with a plurality of circularly arranged premix burners in which a fuel-air mixture is produced before it is ignited and the fuel-air mixture is used as a hot gas stream to drive at least one turbine stage of a gas turbine plant, wherein at least one of said premix burners is operated such that the at least one premix burner has a spatial mixing profile deviating within the fuel-air mixture from all other of said premix burners, wherein the spatially deviating mixing profile is produced by a premix gas perforation within the premix burner that deviates from one region of the premix gas perforation to another.

2. The process according to claim 1, wherein at least three premix burners are operated such that the at least three premix burners have a spatial mixing profile deviating within the fuel-air mixture from all other of said premix burners, and the at least three premix burners are arranged circularly in the annular combustion chamber, equally distributed with equidistant mutual spacing.

3. The process according to claim 1 or 2, wherein the at least one premix burner is operated such that at least one arising asymmetry is brought about within hot gases arising circularly from the totality of all the premix burners, and effectively at least reduces the occurrence of combustion chamber pulsations.

4. An annular combustion chamber with a plurality of circularly arranged premix burners each having a premix gas perforation, for driving a gas turbine, wherein at least one but not all of said premix burners has at least one region in the premix gas perforation, in which adjacent apertures of the premix gas perforation have a different spacing from one another than in the remaining region of the premix gas perforation.

5. The annular combustion chamber according to claim 4, wherein all the other premix burners have a uniformly distributed premix gas perforation.

6. The annular combustion chamber according to claim 4 or 5, wherein downstream openings of the premix gas perforation in the at least one premix burner have a greater mutual spacing than upstream openings of the premix gas perforation in the at least one premix burner.

7. The annular combustion chamber according to claim 4 or 5, wherein upstream openings of the premix gas perforation in the at least one premix burner have a greater mutual spacing than downstream openings of the premix gas perforation in the at least one premix burner.

8. The annular combustion chamber according to claim 4 or 5, wherein at least three of said premix burners each have at least one region in the respective premix gas perforation, in which adjacent apertures of the premix gas perforation have a different spacing from one another than in the remaining region of the premix gas perforation, and said at least three premix burners are arranged circularly equally distributed around the annular combustion chamber.

* * * * *